US006003441A

United States Patent [19]

Little

[11] Patent Number: 6,003,441

[45] Date of Patent: Dec. 21, 1999

[54] WASTE COMPACTING SYSTEM WITH SYSTEM SUPERVISOR

[75] Inventor: Jonathan A. Little, Kalamazoo, Mich.

[73] Assignee: PMDS, L.L.C., Otsego, Mich.

[21] Appl. No.: 09/236,926

[22] Filed: Jan. 25, 1999

[51] Int. Cl.[6] ..... B30B 9/30

[52] U.S. Cl. ..... 100/35; 100/43; 100/50; 100/99; 100/229 A; 702/43

[58] Field of Search ..... 100/35, 48, 50, 100/52, 99, 43, 229 A; 702/43, 173, 188

[56] References Cited

U.S. PATENT DOCUMENTS

| | | | |
|---|---|---|---|
| 4,579,216 | 4/1986 | DeWoolfson et al. | 100/902 |
| 4,953,109 | 8/1990 | Burgis | 100/50 |
| 4,953,682 | 9/1990 | Helbawi | 100/902 |
| 4,979,401 | 12/1990 | Maeda | 100/99 |
| 5,016,197 | 5/1991 | Neumann et al. | 100/50 |
| 5,111,927 | 5/1992 | Schulze, Jr. | 100/902 |
| 5,117,373 | 5/1992 | Huff | 702/173 |
| 5,148,739 | 9/1992 | Fox | 100/99 |
| 5,173,866 | 12/1992 | Neumann et al. | 100/50 |
| 5,214,594 | 5/1993 | Tyler et al. | 100/229 A |
| 5,299,142 | 3/1994 | Brown et al. | 100/229 A |
| 5,299,493 | 4/1994 | Durbin et al. | 100/229 A |
| 5,303,642 | 4/1994 | Durbin et al. | 100/50 |
| 5,469,783 | 11/1995 | Fry | 100/99 |
| 5,558,013 | 9/1996 | Blackstone, Jr. | 100/35 |
| 5,634,398 | 6/1997 | McGee et al. | 100/99 |

FOREIGN PATENT DOCUMENTS

WO 97/40975 11/1997 WIPO .

*Primary Examiner*—Stephen F. Gerrity
*Attorney, Agent, or Firm*—Flynn, Thiel, Boutell & Tanis, P.C.

[57] ABSTRACT

A system (22) for monitoring the fullness of a waste container (20). Waste in the container is compressed by a ram (26). The system includes a sensor (42) for monitoring the force employed to actuate the ram. A container state processor (46) receives the signal from the sensor. The container state processor generates data representative of the fullness of the container. The data generated by the container state processor are transmitted through a modem (50) over the public telephone network to a remote location such as to waste hauler's dispatcher. The system also includes a supervisory processor (58) that is connected to both the container state processor and the modem. The supervisory processor monitors operating state signals generated by both the container state processor (46) and the modem (50). If the operating state signals generated by the container state processor (46) indicate that it is malfunctioning, the supervisory processor (58) attempts to correct for this malfunction. If the operating state signals generated by the modem (50) indicate this it is malfunctioning, the supervisory processor (58) attempts to correct for the malfunction. If corrections for the malfunctions are unsuccessful, the supervisory processor (58) broadcasts an error message over a second modem (136).

28 Claims, 6 Drawing Sheets

WASTE COMPACTING SYSTEM WITH SYSTEM SUPERVISOR

FIELD OF THE INVENTION

This invention relates generally to waste compacting systems employed to compress waste and to provide an indication of the fullness of the container in which the waste is held. More particularly, this invention is directed to a waste compacting system capable of monitoring its own operating state and taking corrective action in the event the system enters an abnormal state.

BACKGROUND OF THE INVENTION

A byproduct of many human activities is the generation of solid waste. At many industrial, commercial, retail and high density residential locations this waste is placed in a large container having a capacity of at least 20 $yd^3$ (15 $m^3$). Often, a waste compacting system is integrally coupled to this container. The waste compacting system includes a powered ram that is used to periodically compress the waste in order to pack as much waste as possible into a single container. An advantage of tightly packing waste in a container is that it minimizes the frequency with which a waste hauler needs to come to the site in order to remove the full container and provide a new, empty, container.

Over the years, the waste compacting systems used to compress waste have evolved into complex systems. Typically, a current waste compacting system includes processing equipment that generates data used to provide an indication of current container fullness and/or predict when, at a time in the future, the container will be full. For example, many compacting systems collect data representative of one or more of the following parameters: the force employed to actuate the compacting ram; the number of times the ram has been actuated since a new container was installed; and the weight of the container. In some current waste compacting systems, a processor internal to the system itself processes this data to provide an indication of current or future container fullness. In other current waste processing systems, the data processors internal to the systems simply store these data to make it available for retrieval by remote processors that perform the data analysis functions.

Accordingly, another component integral with a modern waste compacting system is a modem. The modem is the device that connects a data storage device internal to the waste compacting system to the telephone network so that the data can be forwarded to the appropriate destination. This destination is typically the office of a dispatcher that is associated with the hauler responsible for removing the filled waste containers. Thus, modern waste compacting systems typically include means for providing dispatchers at remote locations the data upon which these individuals can evaluate the fill state of the waste containers. Based on these fill state data, the dispatchers arrange for the pick up and replacement of a waste container at the time closest to when the container is filled to its maximum capacity.

Clearly, current waste compacting systems provide a convenient means to determine the status of waste container with only minimal on-site monitoring. However, there are some problems associated with these systems. In particular, the electronic components integral with these systems are prone to failure. There appear to be several reasons for this. In many locations at which these systems are installed, a significant amount of noise is carried into the systems over the complementary telephone lines. This noise has been found to disrupt the internal program running on a modem that controls the modem. Also, it should be understood that these waste container systems are located in an outside environment. The components forming the system are typically contained in a weather-proof metal housing. The ambient electromagnetic noise in the locations at which these systems are installed is suspected of penetrating these housings and disrupting the normal signal processing performed by the data processing elements and the modem.

One solution proposed to minimize the electromagnetic noise-induced failure of waste compacting systems is to simply provide components better able to withstand exposure to the noise. Clearly, this solution would reduce some of the failures that now occur. However, a disadvantage associated with this solution is that it requires providing components that are typically significantly more expensive to provide than current components. Moreover, these current components, or the housings with which they are integral, are typically of larger size than the current components. Thus, providing these components makes it more difficult to achieve another end goal in the design of waste compacting systems, to make the overall size of each compacting system as small as possible.

SUMMARY OF THE INVENTION

This invention is directed to a new and useful waste compacting system. The waste compacting system of this invention has a container state processor that monitors the fill state of the waste container with which it is used and provides data to a remote terminal that is representative of the container fill state. The waste compacting system of this invention also has a supervisory processor. This supervisory processor does not control the operation of the system ram or collect data used to evaluate container fullness. Instead, the supervisory processor monitors the state of the components of the waste compacting system that control ram actuation, monitor container fullness, and communicate with external data terminals. In the event the supervisory processor detects a failure of one of these components, it takes one of two actions. First, the supervisory processor may send a command to the malfunctioning unit to place the unit in the proper operating state. Alternatively, or should the malfunction unit not correctly restart, the supervisory processor will cause an appropriate message to be sent to a remote terminal advising of the system failure.

An advantage of the system of this invention is that there are many unit failures that the supervisory processor can detect and correct. This ensures that these units, for example the modem and the container state processor, continually function properly even if they enter into a malfunctioning state. This eliminates the expense associated with having to send a service technician to the waste compacting unit to attend to the malfunction. Still another advantage of this system is that it ensures that, even if the system malfunctions, after the supervisory processor makes the necessary correction, the system will again send the required data to the destination terminal. Thus, malfunctions do not affect the ability of the system to send the data to the destination terminals required to schedule the emptying of the container with which this system is used.

BRIEF DESCRIPTION OF THE DRAWINGS

The invention is pointed out with particularity in the claims. The above and further features of this invention may be better understood by reference to the following description taken in conjunction with the following drawings, in which:

DETAILED DESCRIPTION

Figure 1:
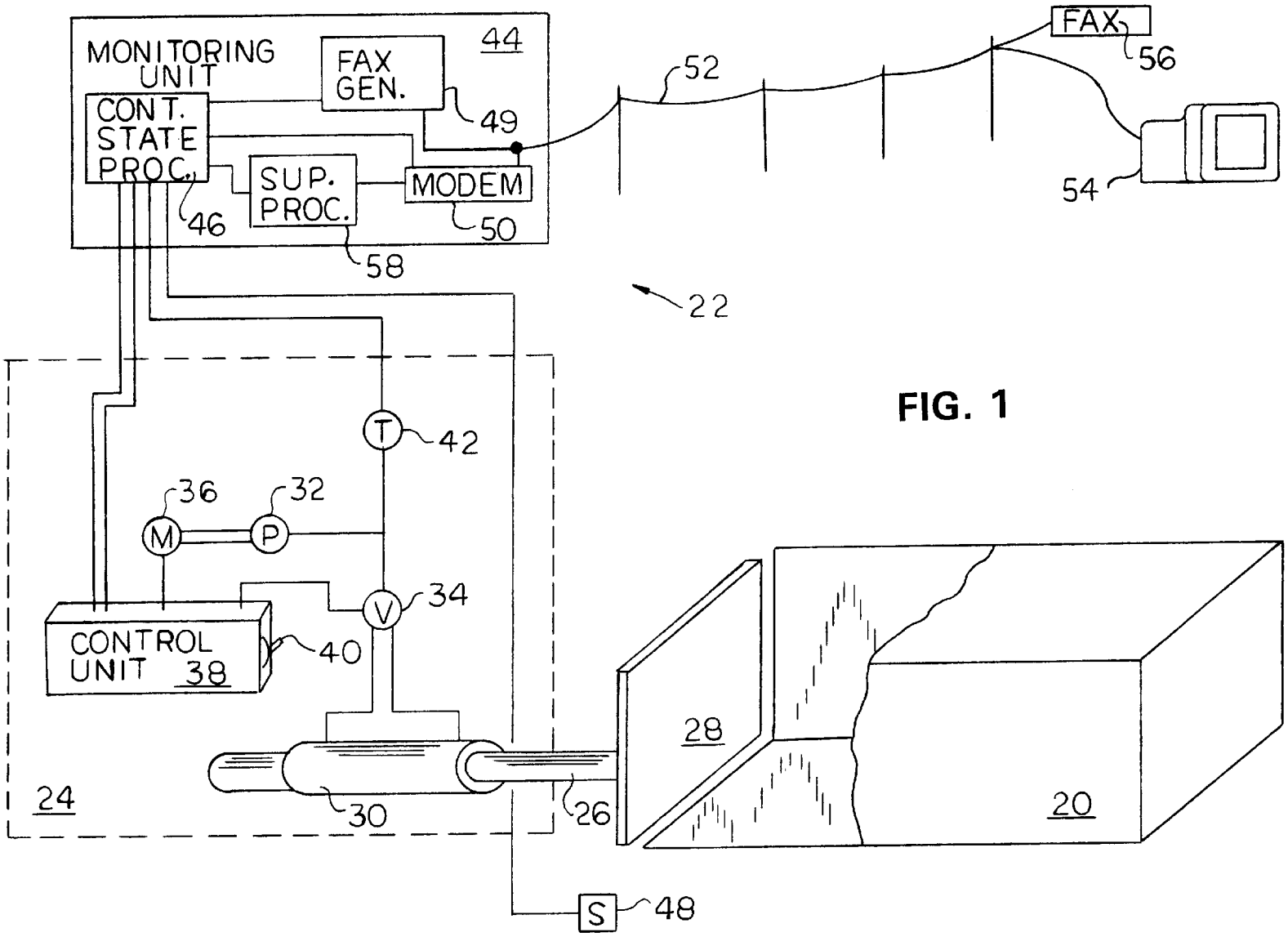
FIG. 1 is a block diagram of the basic components of the waste container compacting and monitoring system of this invention.

FIG. 1 is a block diagram of a waste container 20 and the basic components of the container compacting and monitoring system 22 of this invention that is employed to compress waste in the container and monitor the fullness of the container. The waste container 20 is an elongated container for storing compacted solid waste. The waste container 20 typically has a capacity between 30 $yd^3$ (23 $m^3$) and 85 $yd^3$ (65 $m^3$). System 22 includes a compacting unit 24 with a ram 26 that is selectively actuated to compress the waste in container 20. The ram 26, which is a hydraulically actuated piston, has a head end to which a compaction plate 28 is attached. When the ram 26 is actuated, the compaction plate 28 extends through an open end of container 20 to compress the waste therein. The base end of the ram 26 is fitted in a cylinder housing 30. Hydraulic fluid is selectively applied to and removed from the opposed ends of the cylinder housing 30 in order to cause the extension and retraction of the ram 26.

Pressurized hydraulic fluid is supplied to cylinder housing 30 from a pump 32, also part of the compacting unit 24. The flow of the hydraulic fluid into the opposed ends of cylinder housing 30 is regulated by an electrically controlled valve 34. The pump 32 is energized by a complementary motor 36. A control unit 38, integral with the compacting unit 24, regulates the other components of the compacting unit 24. In particular, control unit 38 regulates the actuation of motor 36 and the setting of valve 34 in order to control when the ram 26 is extended and retracted.

In order to actuate the compacting unit 24, an individual typically depresses a control switch 40 integral with the control unit 38. Depending on the configuration of the compacting unit 24, the ram is then actuated a set number of times or the individual depresses other switches to control the extension and retraction of the ram. One compacting unit 34 that is employed to compress waste in a container 20 is the Model No. CP-4002 compactor manufactured by SP Industries of Hopkins, Mich. This compacting unit 24 can be configured for either automatic or manual control of ram 26.

Integral with the compacting unit 24 is a pressure transducer 42. Pressure transducer 42 is mounted to a branch line of the output port of pump 32. In some constructions of this invention, the pressure transducer 42 is connected to an outlet port of the pump 32 in fluid communication with the side of the hydraulic system through which the hydraulic fluid required to actuate ram 26 flows. Pressure transducer 42 generates a signal representative of the pressure of the hydraulic fluid applied to the ram 26 in order to cause the extension of the ram. In many compacting units 24, the hydraulic pressure that is developed is between 0 and 2500 psi (0 and 176 $Kg/cm^2$). More commonly, this pressure is between 0 and 1500 psi (0 and 105 $Kg/cm^2$).

The system 22 of this invention also includes a monitoring unit 44. Monitoring unit 44 includes a container state processor 46 that receives information from control unit 38 regarding the operation of the compacting unit 24. In particular, container state processor 46 receives data from control unit 38 indicating: the motor on/off state; if the motor is overloaded, (indicated by data representative of the current drawn by the motor); and if the ram is in the static state, being extended or being retracted. The container state processor 46 also receives signals from the transducer 42 representative of sensed hydraulic pressure.

Additional data are provided to the container state processor 46 from a container state sensor 48. The sensor 48 generates a signal indicating whether or not a waste container 20 is connected to the compacting unit 24. Some sensors 48 are optical sensors that monitor the continuity or reflection of a light beam. Other sensors 48 are plunger-type switch sensors. Sometimes, the container state sensor 48 is an integral component of the compacting unit 24. In other versions of the system 22 of this invention, the container state sensor 48 is a stand-alone component.

A memory, (not illustrated) internal to the container state processor 46, stores both the data retrieved by the container state processor 46 and the data generated as a result of any processing steps executed by the processor 46. One suitable processor that can be employed as the container state processor 46 of this invention is a programmable logic controller, Model No. 1C693UDR005FP1 sold by GE Fanuc Automation North America, Inc. of Charlottesville, Va.

The monitoring unit 44 also includes a modem 50 such as a Bocamodem 2400 external modem manufactured by Boca Research, Inc. of Boca Raton, Fla. Modem 50 establishes a link between the waste container compacting and monitoring system 22 of this invention and the outside world over a telephone network 52. Typically, persons at locations remote to the system 20 employ a terminal 54 to access the system 20. Once a communications link is established between terminal 54 and the monitoring unit 44, the data stored in the memory internal to the container state processor 46 are forwarded to the terminal 54 through modem 50. A person reviewing this data is then able to evaluate the fill state of the container 20 in order to schedule the removal and replacement of the container at a time closest to when the container is, or is forecast to be, full.

The monitoring unit also contains a facsimile generator 49. Based on instructions received from the container state processor 46, the facsimile generator 49 produces data that form a facsimile message. These data are transmitted over the telephone network 52 to a facsimile machine 56 at a remote location.

The container state processor 46 can be programmed to cause the generation and transmission of a facsimile message in order to forward to the end location data describing the fill state of the container 20. Alternatively, when either the container 20 or compacting and monitoring system 22 is in a particular state, the container state processor 46 may generate instructions that cause a specific type of facsimile message to be transmitted. For example, whenever the container state processor 46 determines that the container is, or forecast to soon be, filled, the completely filled state, the processor may cause facsimile message generator 49 to generate a facsimile message indicating this fill state. Alternatively, if the container state processor 46 monitors the motor 36 and the processor 46 determines that the motor has not shut off, the container state processor 46 may cause the generation of a facsimile message reporting the malfunctioning state of the motor.

Monitoring unit 44 also includes a supervisory processor 58 that is separate from the container state processor 46. The supervisory processor 58 is connected to both the container state processor 46 and the modem 50 for monitoring the operating states of these components. As described hereinafter, in the event the supervisory processor 58 determines that either the container state processor 46 or the modem 50 are improperly functioning, the supervisory processor 58 generates command signals to correct for the malfunction. One suitable microprocessor that can be employed as the supervisory processor 58 is the Parallax BS2I-IC processor manufactured by Parallax, Inc. of Rockland, Calif.

Figure 2:
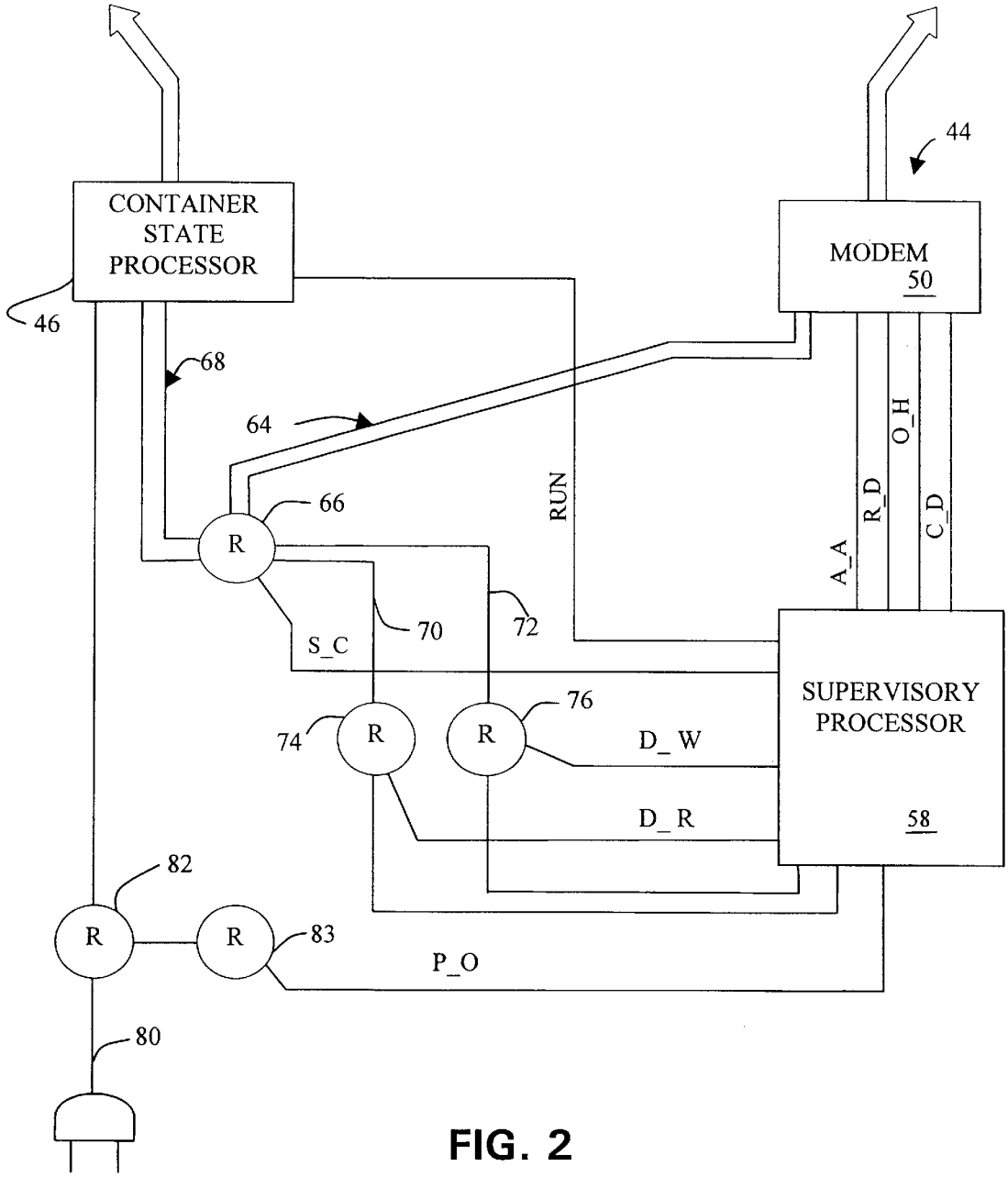
FIG. 2 is block diagram depicting the connections of the components internal to the monitoring unit.

A more detailed understanding of the components internal to the monitoring unit 44 is now obtained by reference to FIG. 2. Data and control signals are written from and read into the modem 50 through a two-line data bus 64. In some versions of this invention, data are serially outputted from modem 50 over one line of bus 64 and data are serially inputted into the modem over the second line of bus 64. The end of bus 64 furthest from modem 50 is connected to a relay 66 which may be either a mechanical switch relay or comprise a set of switching transistors. Relay 66 regulates if bus 64 is connected to either the container state processor 46 or the supervisory processor 58. More specifically, relay 66 connects bus 64 to a second bus 68 that is connected to the data I/O terminals of the container state processor 46. Alternatively, relay 66 establishes a connection between bus 64 and data lines 70 and 72 that are themselves selectively connected to the supervisory processor 58.

Relay 66 also receives a SUPERVISOR_CONNECT (S_C) signal from the supervisory processor 58. When the SUPERVISORY_CONNECT signal is not asserted, relay 66 connects bus 64 to bus 68. When the SUPERVISORY_CONNECT signal is asserted, relay 66 connects the conductors forming bus 64 to data lines 70 and 72.

Data lines 70 and 72 are connected to the supervisory processor through normally open relays 74 and 76, respectively. Relays 74 and 76 are, respectively, closed by the assertion of DATA_READ (D_R) and DATA_WRITE (D_W) signals which are selectively asserted by the supervisory processor 58. During the time periods in which supervisory processor 58 is exchanging data with the modem 50, the supervisory processor 58 selectively asserts the DATA_READ and DATA_WRITE signals in order to ensure that, at any given moment in time, it is only reading data from or writing data to the modem 50.

The modem 50 selectively forwards the supervisory processor 58 signals that provide information about the operating state of the modem. A first one of these signals is an AUTO_ANSWER (A_A) signal. The AUTO_ANSWER signal is asserted by the modem 50 whenever it is in the auto answer mode; that is when the modem is set to answer any incoming telephone calls that are received by the modem. A second signal generated by the modem is the RING_DETECT (R_D) signal. Modem 50 asserts the RING_DETECT signal each time it detects an incoming ring signal that is received from over the telephone network 52. The RING_DETECT signal consists of a pulse signal stream that has a period and on-time characteristics that approximate the ring pulses received by the modem 50.

A third signal that the modem 50 asserts is the $OFF_{13}$ HOOK (0—H) signal. The OFF_HOOK signal is asserted by the modem 50 whenever the modem goes into an "off-hook" state in which it closes its internal switch to establish an electrical connection to the telephone network 52. The fourth signal modem 50 selectively asserts is a CARRIER_DETECT (C_D) signal. The CARRIER_DETECT circuit is asserted by the modem 50 whenever a monitoring circuit internal to the modem determines the presence of a carrier signal on the transmit side of the modem. The presence of the carrier signal means that the modem is transmitting a signal out over the telephone network 52.

Supervisory processor 58 also regulates the operation of the container state processor 46. In the depicted version of the invention, the supervisory processor 58 more particularly regulates the on/off state of the container state processor 46. More specifically, the supervisory processor 58 performs this regulation by regulating the application of the energization current applied to the container state processor 46 over a power line 80. A relay 82 regulates current flow through power line 80 to the container state processor 46. The open/closed state of relay 82 is regulated by a 5 VDC control signal generated by a driver relay 83. Driver relay 83 generates the control signal based on a PROCESSOR_ON (P_O) signal generated by the supervisory processor 58. During normal operation of the system 22 of this invention, supervisory processor 58 generates the PROCESSOR_ON control signal. The assertion of PROCESSOR_ON signal causes first relay 83 and then relay 82 to close so as to result in the application of the current required to energize container state processor 46.

Container state processor 46 also provides state information to the supervisory processor 58. Specifically, whenever the container state processor 46 is properly functioning, the processor 46 asserts a PROCESSOR_RUNNING (RUN) signal to the supervisory processor 58.

Figure 3:
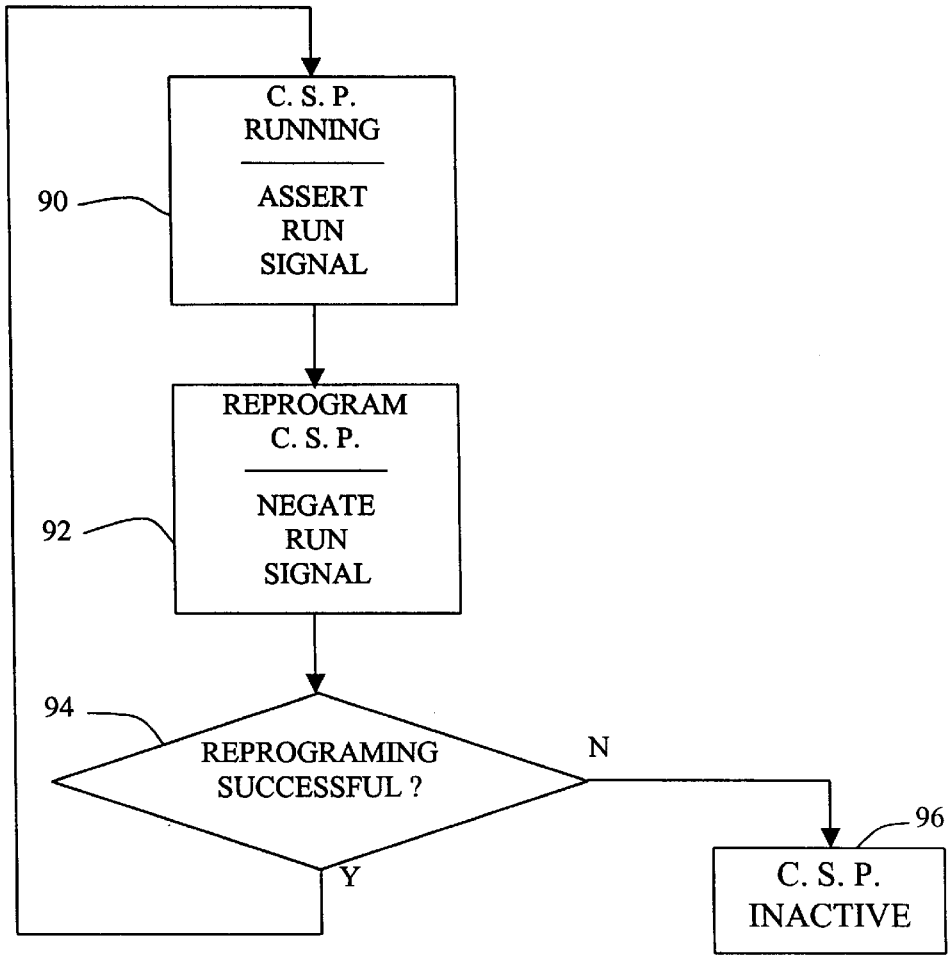
FIG. 3 is a flow diagram depicting the process steps that occur during the reprogramming of the containers state processor.

When the system 22 of this invention is in operation, and the container state processor 46 is operating normally, a program module internal to processor 46 causes processor 46 to assert the PROCESSOR_RUNNING signal as represented by step 90 of FIG. 3. When programming signals are forwarded to the container state processor 46 through modem 50, the container state processor 46 drops out of the run mode as represented by step 92. As part of step 92, the assertion of the PROCESSOR_RUNNING signal by the container state processor 46 is negated.

Once the reprogramming of the container state processor 46 is completed, (step not depicted) the operating system internal to the processor 58 evaluates whether or not the reprogramming was successful in step 94. If the reprogramming was successful, container state processor 46 returns to step 90 and the PROCESSOR_RUNNING signal is reasserted. If, however, the programming was unsuccessful, the container state processor 46 enters an inactive state represented by step 96. As long as the container state processor 46 remains in the inactive state, the processor 46 does not assert the PROCESSOR_RUNNING signal.

The supervisory processor 58 operates simultaneously with the operation of the container state processor 46. As long as the system is operating normally, the supervisory processor 58 asserts a SUPERVISOR_CONNECT signal to relay 66. Relay 66, upon receiving the SUPERVISORY_CONNECT signal, establishes a communications link between the container state processor 46 and the modem 50 over buses 64 and 68.

Figure 4:
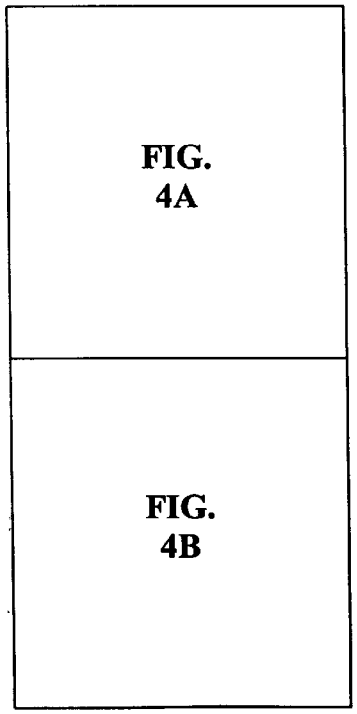
FIG. 4 is an assembly diagram depicting how
Figure 4A:
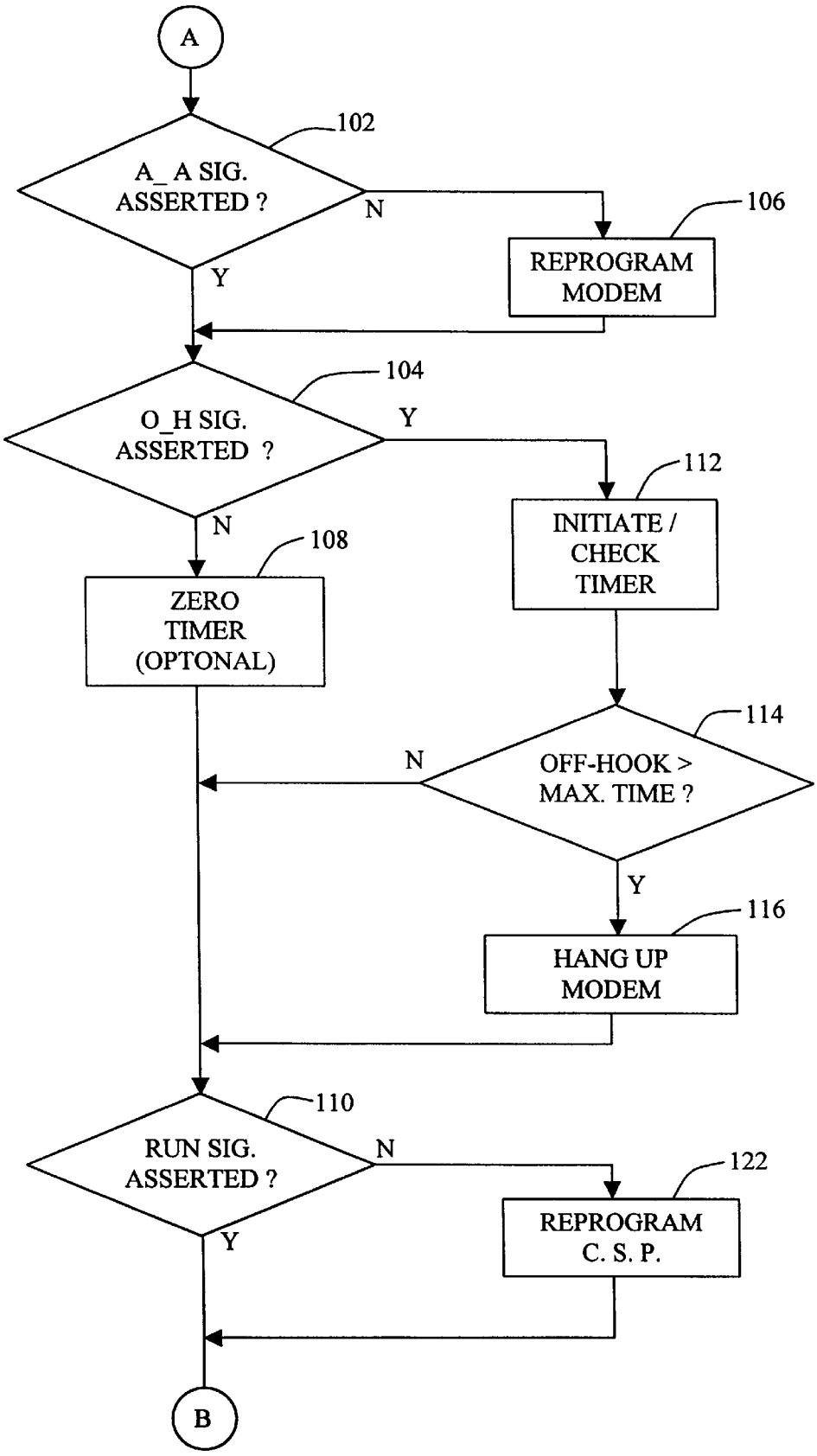
FIGS. 4A and 4B are assembled to form a flow diagram of the process steps executed by the supervisory processor of this invention.
Figure 4B:
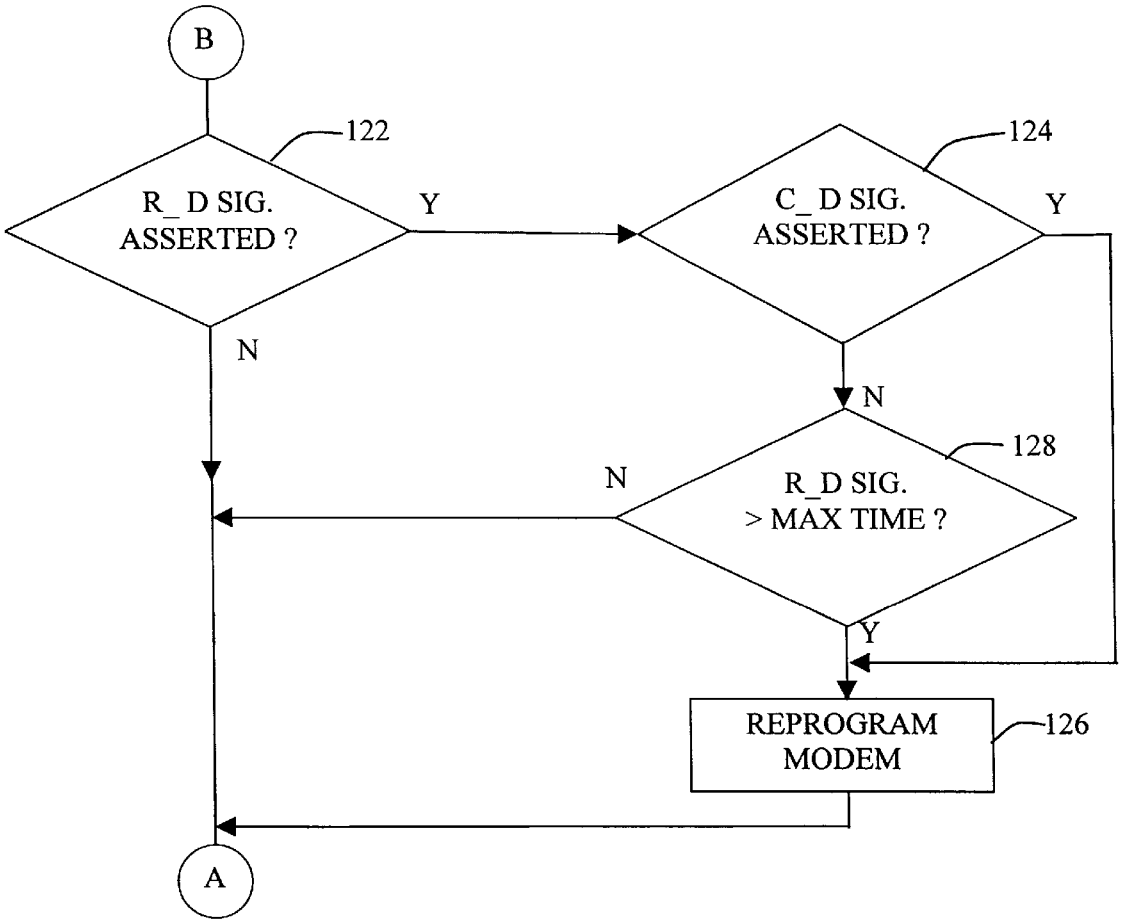

Supervisory processor 58 monitors the operation of the container state processor 46 and modem 50 as depicted by the flow chart of FIGS. 4A and 4B. Specifically, in step 102, the supervisory processor 58 evaluates whether or not modem 50 is asserting the AUTO_ANSWER signal. If the AUTO_ANSWER signal is being asserted, supervisory processor 58 proceeds to step 104. However, if the AUTO_ANSWER signal is not being asserted, supervisory processor 58 reprograms the modem as represented by step 106. In step 106, the supervisory processor 58 asserts the SUPERVISOR_CONTROL signal to relay 66 to establish a connection between bus 64 and data lines 70, 72. Then, in order to actually reprogram the modem, supervisory processor 58 asserts the DATA_READ and DATE_WRITE signals to relays 74 and 76, respectively. The assertion of these signals sets relays 74 and 76 so that the supervisory processor 58 can send the programming instructions to modem 50.

As part of the reprogramming process, supervisory processor 58 receives acknowledgement signals back from the modem 50. When it is time for the supervisory processor 58 to receive these acknowledgements, the supervisory processor 58 asserts the DATA_READ and DATA_WRITE signals to relays 74 and 76, respectively. The resultant resetting of the open/closed states of relays 74 and 76 configure data lines 70 and 72 so that data can only flow from the modem 50 to the supervisory processor 58. Once the modem has been reprogrammed, supervisory processor 58 executes step 104.

In step 104, supervisory processor 58 determines if the modem 50 is asserting the OFF_HOOK signal. If the OFF_HOOK signal is not being asserted, supervisory processor 58 may execute an optional zero timer step 108, discussed hereinafter. Supervisory processor 58 then proceeds to execute step 110.

If the OFF_HOOK signal is being asserted, supervisory processor 58 executes an initiate timer/check timer step 112 depending on whether or not the timer was previously initiated. More specifically, if this timer was not previously initiated, in step 112 it is initiated to start a clock to indicate the time period for which the OFF_HOOK signal is asserted. If the timer was previously initiated, in step 112 the total time clocked by the timer is read. Once the time is read, supervisory processor 58, in step 114, compares the time the modem has been in the off-hook state to a maximum time. In one version of this invention, this maximum time is 30 minutes. If the time the modem 50 is off-hook has been less than the maximum time, supervisory processor 58 executes step 110. (It should be understood that after the timer is initiated, the first time the OFF_HOOK signal is not received, supervisory processor 58 executes step 108 to zero the timer.) If, however, the modem has been off-hook for a period greater than the maximum time, supervisory processor 58 executes a step 116. In step 116, supervisory processor 58 generates a "hang-up" command to modem 50 to instruct the modem to break the connection to the telephone line 52. During the execution of step 116, it should be understood that supervisory processor 58 appropriately asserts and negates the SUPERVISOR_CONTROL, DATA_READ and DATA_WRITE signals to the relays 66, 70 and 72, respectively, to ensure the proper flow of instructions and acknowledgement signals between from and to the processor 58. Once the modem 50 disconnects from the telephone line 52, supervisory processor 58 executes step 110.

In step 110, supervisory processor 58 monitors the operating state of the container state processor 46. In the described embodiment of this invention, this monitoring is performed by evaluating whether or not the container state processor 46 is asserting the PROCESSOR_RUNNING signal. If the PROCESSOR_RUNNING signal is being asserted, supervisory processor 58 proceeds to execute step 120.

If the PROCESSOR_RUNNING signal is not being asserted, supervisory processor 58 executes a step 122 in which the supervisory processor 58 reprograms the container state processor 46. In the depicted version of the invention, supervisory processor 58 performs this reprogramming by forcing the reinitialization of the container state processor 46. Supervisory processor 58 causes this reprogramming by negating the PROCESSOR_ON signal to relay 82. The negation of the PROCESSOR_ON signal turns the container state processor 46 off. In some versions of the invention, the supervisory processor 58 turns off container state processor 46 for approximately a one minute period of time. After this time out period has passed, supervisory processor 58 reasserts the PROCESSOR_ON signal to relay 82. This results in the reenergization of container state processor 46. The program initialization subroutine internal to the container state processor 46 is then reexecuted to cause the reprogramming of the container state processor 46. After reprogramming of the container state processor 46, supervisory processor 58 proceeds to execute step 122.

In step 122, supervisory processor 58 evaluates whether or not modem 50 is asserting the RING_DETECT signal. Typically, supervisory processor 58 monitors whether or not the RING_DETECT signal is being asserted for an extend time period of 30 to 90 seconds. This is because the RING_DETECT signal is a pulse signal. Accordingly, this extended monitoring is required in order to determine if the pulses forming the RING_DETECT signal have been received. If the RING_DETECT signal is not being asserted, the supervisory processor returns to execute step 102.

If the RING_DETECT signal is being asserted, supervisory processor 58 initially checks to determine if the CARRIER_DETECT signal is also being asserted as represented by step 124. If both the RING_DETECT and CARRIER_DETECT signals are being asserted simultaneously, it is assumed the modem 50 has entered some type of fault state. Accordingly, supervisory processor 58 proceeds to execute step 126. In step 126, the supervisory processor 58 reprograms the modem 50 in order to force the modem out of the fault state. In step 126, supervisory processor 58 executes the basic steps executed in step 106. Once step 126 is executed, supervisory processor 58 proceeds to execute step 102.

If, in step 124, it is determined that the CARRIER_DETECT signal is not being received, the supervisory processor executes decision step 128. In step 128, the supervisory processor 58 monitors for how long the pulses forming the RING_DETECT signal are received. If the pulses are received for less than a given period of time, typically between 60 and 180 seconds, it is assumed that the modem 50 has answered the incoming telephone call or the caller has hung-up. If this determination is made in step 128 it is assumed that the modem 50 is operating normally. Accordingly, the supervisory processor 58 proceeds to reexecute step 102.

However, if it is determined in step 128 that the pulses forming the RING_DETECT signals have been continually received for more than the given time period, it is assumed that the modem 50 has failed to answer an incoming telephone call. Therefore, supervisory processor 58 executes step 126 to force the modem out of this fault state.

When the container state processor 46 and modem 50 of the system 22 of this invention are operating normally, the supervisory processor 58 does not interfere with the operation of these components. However, in the event either the container state processor 46 or the modem 50 malfunction, the malfunction is detected by the supervisor processor 58. The supervisory processor 58, in turn, generates a sequence of instructions to cause the component in question to correct for the malfunction. Thus, the supervisory processor 58 corrects for malfunctions in the container state processor 46 and modem 50 as they occur. This ensures that the system 22 will operate continuously even if the container state processor 46 and modem 50 do malfunction. Also, since the supervisory processor 58 corrects for container state processor 46 and modem 50 malfunctions, there is no need to have a service technician attend to the system 22 each time these components malfunction. Thus, the system is designed to minimize both the time and expense associated with attending to the malfunctions associated with its internal components.

Figure 5:
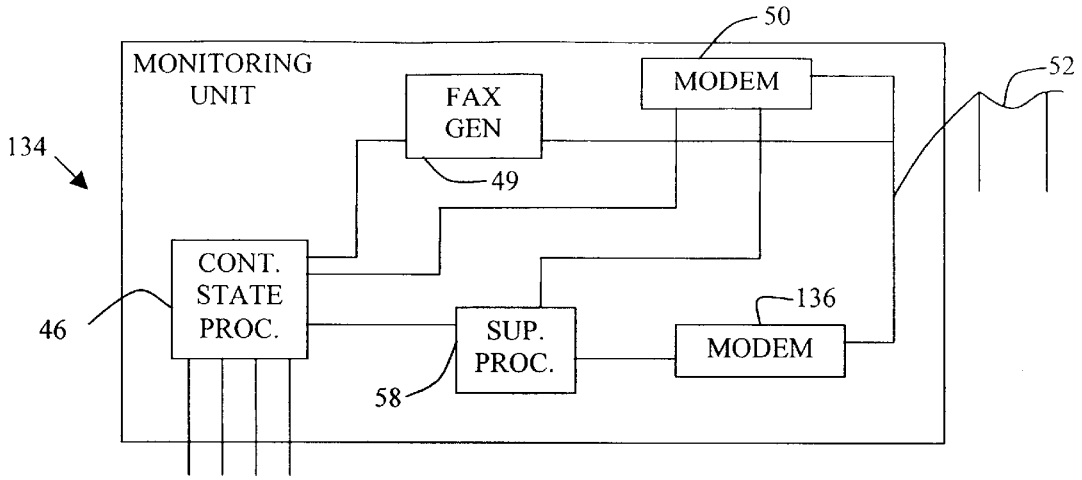
FIG. 5 is a block diagram of an alternative monitoring unit of the waste container compacting system of this invention.

FIG. 5 depicts an alternative monitoring unit 134 of the container compacting system 22 of this invention. Monitoring unit 134 includes the same basic container state processor 46, facsimile generator 49, modem 50 and supervisory processor 58 described with respect to the first invention. The monitoring unit 134 also includes a second modem 136. Modem 136, like modem 50, is connected to the telephone network. Modem 136 accepts data signals for transmission from the supervisory processor 58. In the depicted version of the invention, both modems 50 and 136 are connected to the telephone network through a single line so as to hold subscriber charges to a minimum. The supervisory processor 58 controls the on/off states of both modem 50 and modem 136.

Figure 6:
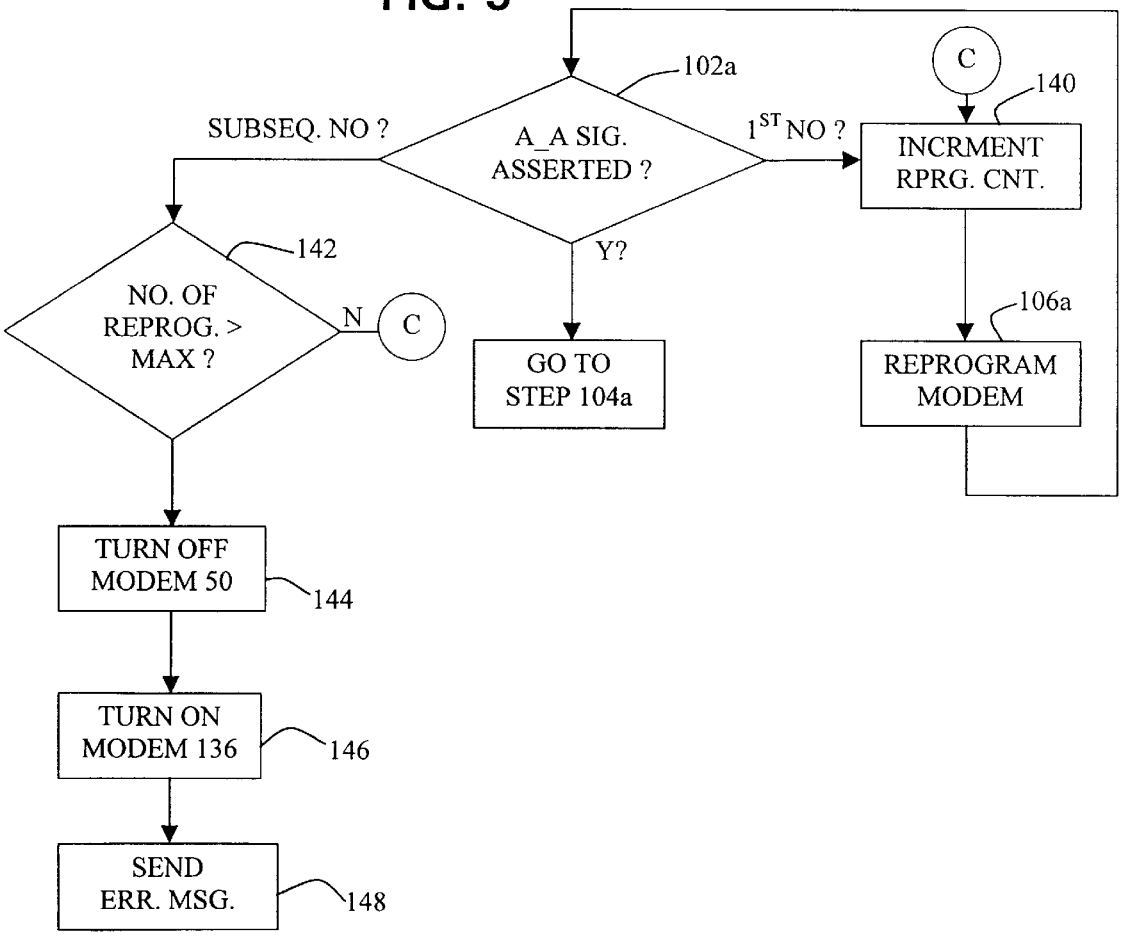
FIG. 6 is a flow diagram of some of the process steps performed by the monitoring unit of FIG. 5.

In this version of the invention, the supervisory processor 58 is capable of sending error messages in the event the supervisory processor 58 determines a malfunction occurred in one of the components the processor is monitoring. Normally, when no malfunctions are detected, supervisory processor 58 actuates modem 50 while leaving modem 136 in the off state. Thus, modem 50 functions as the normal device through which container state processor 46 exchanges signals with the remote terminal 54 and sends facsimiles as has been previously described. FIG. 6 partially depicts how the supervisory processor 58 in this embodiment of the invention performs its monitoring and control of the other elements of the compacting system 22. The supervisory processor begins with step 102*a*, which is similar to previously described step 102 in which the supervisory processor determines whether or not modem 50 is asserting the AUTO_ANSWER signal indicating that the modem is in the auto answer mode. If, in step 102*a*, it is determined that the AUTO_ANSWER signal is being asserted, supervisory processor 58 determines whether or the OFF_HOOK signal is being asserted, a step 104*a*. Step 104*a*, and the subsequent steps are similar to the steps described with respect to FIGS. 4A and 4B so they will not be described in any more detail.

If, however, in step 102*a*the supervisory processor 58 determines that the AUTO_ANSWER signal is not asserted, the supervisory processor also determines whether or not this is the first failure to receive the AUTO_ANSWER signal or a ongoing failure. By "first failure" it is understood to mean the first failure to receive the AUTO_ANSWER signal after a period of time in which the signal was received. If this is the first failure to receive the AUTO_ANSWER signal, supervisory processor 58 proceeds to a step 140 in which it increments a failure count filed, which was previously zeroed. After the failure count field has been incremented, supervisory processor executes previously described step 106 in which it attempts to reprogram the modem 50.

Once step 106 has been executed, supervisory processor returns to immediately reexecute step 102*a*. If the reprogramming was successful, the modem 50 will be asserting the AUTO_ANSWER signal. The supervisory processor will proceed to execute step 104*a* as has been previously described. Prior to preceding to step 104*a*, supervisory processor 58 will first zero out the failure count field, step not shown. However, after the reprogramming, modem 50 may still not be in the auto answer mode and still not be asserting the AUTO_ANSWER signal. If this is the condition, in this second execution of step 102*a*, supervisory processor 58 will make a determination that there has been a ongoing failure to receive the AUTO_ANSWER signal. Thus it should be understood that an "ongoing failure" is a failure that exists even after the modem has been reprogrammed.

If the supervisory processor 58, in step 102*a*, determines that the malfunction is an ongoing failure, the supervisory processor in step 142 first determines from the failure count field and a stored fixed reference value if the number of failures is greater than a maximum number of allowable failures. If it is determined that the number of failures is less than the allowable number, supervisory processor 58 first reexecutes step 140 so as to again increment the failure count field. Once step 140 has been reexecuted, supervisory processor 58 reexecutes step 106*a* and 102 as have been previously described.

However, if in step 142 it is determined that the number of failures is greater than the maximum number of failures, the supervisory processor 58 recognizes the situation as one in which its reprogramming cannot correct the malfunction of the modem 50. If this determination is made, the supervisory processor 58 first proceeds to a step 144 in which the supervisory processor 58 turns off modem 50. The supervisory processor 58 then proceeds to execute a step 146 in which modem 136 is turned on. Once modem 136 is turned on, supervisory processor 58 executes a step 148. In step 148, supervisory processor generates data that form an error message and cause the data to be transmitted over the telephone network by modem 136. For example, in one version of this invention, supervisory processor 58 causes the modem 136 to dial a telephone number that has been assigned to a pager. Once a connection to the pager control unit has been established, supervisory processor 58 causes the overdialing of an identification number into the pager that identifies the malfunctioning monitoring unit 134. Thus, a technician or other individual having possession of the pager will receive a message that identifies which monitoring unit 134 is in need of maintenance.

It should be understood that, in this version of the invention, supervisory processor 58 is likewise configured to check to determine if the appropriate state signals are generated after each reprogramming of the container state processor 46 or the modem 50. Once, a malfunction has been detected and the plural attempts to correct same have been unsuccessful, the supervisory processor 58 will cause the broadcast of an error message as has been described.

One advantage of this version of the invention is that the supervisory processor 58 is configured to try a multiple number of times to correct the malfunctions the processor 58 detects. Thus, in the event a single reprogramming does not correct the malfunction, the multiple reprogrammings may have the desired effect. Also, while not depicted, the supervisory processor 58 may be configured so that if a first set of reprogramming instructions does not correct a malfunction, the supervisory processor will transmit one or more sets of alternative reprogramming instructions in order to place the modem 50 back in proper operation.

Still another advantage of this version of the invention is that, in the event the attempts at reprogramming the modem 50 are unsuccessful, the supervisory processor 58 will cause the transmission of a message announcing the error. Since a separate modem 136 broadcasts the error messages generated by supervisory processor 58, the malfunctions of modem 50 will not prevent the error messages from being broadcast. This will provide prompt notice to persons charged with monitoring the system 22 that a malfunction that may require on-site attention has occurred. The embedding of the error message in a page that includes information identifying the malfunctioning system 22, means that persons do not always have to be physically located in the dispatcher's office, near terminal 54 or facsimile machine 56, in order to find out about the malfunction.

Also, another feature of this invention is that modems 50 and 136 share the same subscriber line. This reduces the line charges associated with maintaining the compacting system 22.

It should be recognized that the foregoing description is directed to one particular embodiment of this invention and that other versions of the invention may vary from what has been described. For example, in the described version of the invention, the container state processor 46, the modem 50 and the supervisory processor 58 are separate components. In other versions of this invention, two or all of these components may be integrated into a single unit. If the container state processor 46 and the supervisory processor 58 are integrated into a single processing unit, then their functions are performed based on instructions contained in separate modules that are executed concurrently or simultaneously by the processing unit.

Moreover, in other versions of this invention, the supervisory processor 58 may perform tests different from what has been described. For example, the supervisory processor 58 may monitor how long the CARRIER_DETECT signal is received. If this signal is received for an extended period of time, the supervisory processor 58 may view this condition as indicating that the modem 50 has entered a fault state and will then take appropriate action to remedy this fault.

Also, the supervisory processor 58 may monitor other signals in order to evaluate the operating state of this system 22. It may be desirable, for example, for the supervisory processor 58 to monitor the signal from the pressure transducer 42, or other transducer that measures the force required to actuate the ram 26. If this signal varies from what is expected, the supervisory processor 58 will interpret this variation as indicating that the compacting unit 24 has entered some type of fault state. If this determination is made, the supervisory processor 58 can then generate appropriate commands to the container state processor 46 to cause the container state processor 46 to force the compacting unit 24 out of the fault state.

Similarly, in some versions of the invention, supervisory processor 58 may actually forward programming signals to the container state processor 46 in order to correct for malfunctions. The supervisory processor 58 may be able to perform this reprogramming in addition to or as a substitute for the controlling the actuation of container state processor 46 by the regulation of the actuation of the processor 46.

It should similarly be recognized that the process steps described with respect to FIG. 6 need not always be carried out using the components depicted in FIG. 5. For example, some versions of this invention may not have a second modem. In these versions of the invention, supervisory processor 58 is connected to modem 50 to force the modem to transmit the error messages indicating that a malfunction in the monitoring unit has been detected.

Therefore, it is the object of the appended claims to cover all such modifications and variations that come within the true spirit and scope of the invention.

What is claimed is:

1. A waste compacting system for compressing waste in a container, said system including:

a ram for compressing waste in the container;

a ram actuator connected to said ram for actuating said ram, wherein said ram actuator employs variable amounts of force to actuate said ram;

a monitoring unit, said monitoring unit including:

a sensor connected to said ram actuator for monitoring the force used by said ram actuator to actuate said ram, said sensor generating a sensor signal representative of the force used to actuate said ram;

a container state processor connected to receive the sensor signal, said container state processor configured to produce container state data based on the sensor signal representative of a fullness level of the container, wherein said container state processor is further configured to produce a PROCESSOR_RUN signal representative of an operating state of said container state processor;

a first modem connected to receive the container state data and to transmit the container state data over an external communications network, wherein said first modem is further configured to generate at least one modem state signal representative of the operating state of said first modem and to receive modem programming signals that regulate the operating state of said first modem; and a supervisory processor connected to receive the PROCESSOR_RUN signal and the modem state signal, said supervisory processor being connected to said container state processor for controlling the operation of said container state processor and to said first modem for generating the modem programming signals, wherein said supervisory processor is configured to control said container state processor based on the state of the PROCESSOR_RUN signal and to selectively generate the modem programming signals based on the modem state signal.

2. The waste compacting system of claim 1, wherein said container state processor and said supervisory processor are separate components.

3. The waste compacting system of claim 1, wherein: said first modem generates a plurality of modem state signals; and said supervisory processor is configured to generate a plurality of different sets of modem programming signals and generates a select set of modem programming signals based on the particular modem state signals generated by said first modem.

4. The waste compacting system of claim 1, wherein said supervisory processor is connected to said container state processor for controlling actuation of said container state processor and controls the actuation of said container state processor based on the state of the PROCESSOR_RUN signal.

5. The waste compacting system of claim 4, wherein said supervisory processor regulates the application of energization power to said container state processor to control the actuation of said container state processor.

6. The waste compacting system of claim 1, wherein:

a first communications link extends from said first modem over which data are written to said first modem and read from said first modem;

a second communications link extends from said container state processor over which data are written to and read from said container state processor;

a third communications link extends from said supervisory processor over which data are written to and read from said container state processor;

a first relay selectively connects said first communications link to said second communications link or said third communications link based on receipt of a SUPERVISORY_CONNECT signal; and said supervisory processor selectively asserts the SUPERVISORY_CONNECT signal.

7. The waste compacting system of claim 6, wherein:

said third communications link includes a first data line over which data are written to said supervisory processor and a second data line over which data are read from said supervisory processor;

said first data line is selectively connected to said supervisory processor through a second relay and said second data line is selectively connected to said supervisory processor through a third relay; and said supervisory processor controls actuation of said second and third relays to control which of said first or second data lines is connected to said supervisory processor.

8. The waste compacting system of claim 1, wherein said supervisory processor is further configured to selectively generate an error message for transmission over an external network based on the state of the PROCESSOR_RUN signal or the modem state signal.

9. The waste compacting system of claim 8, wherein said supervisory processor is further configured to generate the error message based on the state of the PROCESSOR_RUN signal after said supervisory processor engages in control of said container state processor or based on the modem state signal after said supervisory processor generates the modem programming signals.

10. The waste compacting system of claim 9, wherein said monitoring unit further includes a second modem that is separate from said first modem and said supervisory processor forwards the error message to the second modem and said second modem transmits the error message over the communications network.

11. The waste compacting system of claim 8, wherein said monitoring unit further includes a second modem that is separate from said first modem and said supervisory processor forwards the error message to the second modem and said second modem transmits the error message over the communications network.

12. A waste compacting system for compressing waste in a container, said system including:

a compacting member for compressing waste in the container;

an actuating unit connected to said compacting member for displacing said compacting member to cause displacement of the compacting member, wherein said actuating unit uses variable amounts of force to actuate said compacting member;

a monitoring unit, said monitoring unit including:

a sensor connected to said actuating unit for monitoring the force used by said actuating unit to actuate said compacting member, said sensor generating a sensor signal representative of the force used to actuate said compacting member;

a container state processor connected to receive the sensor signal, said container state processor configured to produce container state data based on the sensor signal that is representative of a fullness level of the container, wherein said container state processor is further configured to produce a PROCESSOR_RUN signal representative of the operating state of said container state processor;

a modem connected for receiving the container state data and to transmit the container state data over an external communications network, wherein said modem is further configured to generate at least one modem state signal representative of the operating state of said modem and to receive modem programming signals that regulate the operating state of said modem;

a communications bus over which the container state data are forwarded from said container state processor to said modem; and a supervisory processor separate from said container state processor connected to receive the PROCESSOR_RUN signal and the modem state signal, said supervisory processor being connected to said container state processor for controlling the operation of said container state processor and to said communications bus for outputting the modem programming signals to said modem, wherein said supervisor processor is configured to control said container state processor based on states of the PROCESSOR_RUN signal and to selectively generate the modem programming signals based on the modem state signal and said supervisory processor controls which of said container state processor or said supervisory processor forwards data or the modem programming signals to said modem over said communications bus.

13. The waste compacting system of claim 12, wherein: said modem generates a plurality of modem state signals; and said supervisory processor is configured to generate a plurality of different sets of modem programming signals and generates a select set of modem programming signals based on the particular modem state signals generated by said modem.

14. The waste compacting system of claim 12, wherein said supervisory processor is connected to said container state processor for controlling actuation of said container state processor and controls the actuation of said container state processor based on the state of the PROCESSOR_RUN signal.

15. The waste compacting system of claim 14, wherein said supervisory processor regulates the application of energization power to said container state processor to control the actuation of said container state processor.

16. The waste compacting system of claim 12, further including a first relay connected to said communications bus and said supervisory processor for selectively connecting said container state processor or said supervisory processor to said modem over said communication bus; and wherein said supervisory processor selectively controls the state of said first relay.

17. The waste compacting system of claim 16, wherein:

a first data line extends from said supervisory processor to said first relay over which data are written to said supervisory processor and a second data line extends from said supervisory processor over which data are read from supervisory processor;

said first data line is selectively connected to said supervisory processor through a second relay and said second data line is selectively connected to said supervisory processor through a third relay; and said supervisory processor controls actuation of said second and third relays to control which of said first or second data lines is connected to said supervisory processor.

18. A method of monitoring the fullness of a waste container in which the waste is compressed with a compactor, said method including the steps of:

monitoring the force employed by the compactor to compress the waste in the container with a sensor to produce a sensor signal representative of the force employed by the compactor;

forwarding the sensor signal to a compactor state processor that produces compactor fullness data based on the sensor signal;

providing a first modem that is connected between the public telephone network and the compactor state processor for providing a communications link between the telephone network and the compactor state processor over which the compactor fullness data are transmitted over the public telephone network; and with a supervisory processor, monitoring the operation of the compactor state processor and the operation of the first modem, wherein:

when the supervisory processor determines that the compactor state processor is not operating, the supervisory processor generates commands to force proper operation of the compactor state processor; and when the supervisory processor determines that the first modem is not properly operating, the supervisory processor generates commands to the first modem to cause proper operation of the first modem.

19. The method of monitoring the fullness of a waste container of claim 18, wherein the supervisory processor performs said step of generating commands to force proper operation of the compactor state processor by regulating the actuation of the container state processor.

20. The method of monitoring the fullness of a waste container of claim 19, wherein the supervisory processor performs said step of regulating the actuation of the container state processor by regulating the application of energization current to the container state processor.

21. The method of monitoring the fullness of a waste container of claim 18, wherein:

the container state processor performs internal monitoring of the operating state of the container state processor and, when said internal monitoring indicates that the container state processor is properly functioning, the container state processor generates a PROCESSOR_RUN signal; and the supervisory processor performs said step of monitoring the operation of the container state processor by monitoring whether or not the PROCESSOR_RUN signal is being generated.

22. The method of monitoring the fullness of a waste container of claim 18, wherein:

the first modem generates at least one state signal indicating the operating state of the first modem; and the supervisory processor performs said step of monitoring the operation of the first modem by evaluating the state signal generated by the first modem.

23. The method of monitoring the fullness of a waste container of claim 18, the first modem generates a plurality of state signals that indicate the operating state of the first modem; and the supervisory processor performs said step of monitoring the operation of the first modem by evaluating which of the state signals are generated by the first modem.

24. The method of monitoring the fullness of a waste container of claim 23, wherein:

the first modem is selectively programmable; and the supervisory processor performs said step of generating commands to the first modem by outputting programming instructions to the first modem, wherein the supervisory processor outputs selective programming instructions to the first modem based on the state signals generated by the first modem.

25. The method of monitoring the fullness of a waste container of claim 18, wherein:

the first modem is selectively programmable; and the supervisory processor performs said step of generating commands to the first modem by outputting programming instructions to the first modem, wherein the supervisory processor outputs selective programming instructions to the first modem based on said step of monitoring the operating state of the first modem.

26. The method of monitoring the fullness of a waste container of claim 18, wherein:

after the supervisory processor performs said step of generating commands to force proper operation of the container state processor, the supervisory processor remonitors the operation of the container state processor and, if said supervisory processor determines that the container state processor is not operating, said supervisory processor generates an error message; and after the supervisory processor performs said step of generating commands to cause proper operation of the first modem, the supervisory processor remonitors the operation of the first modem and, if said supervisory processor determines that the first modem is not operating, said supervisory processor generates an error message.

27. The method of monitoring the fullness of a waste container of claim 26, wherein:

a second modem separate from the first modem is provided; and when, after said remonitoring of the first modem the supervisory processor determines that the first modem is not operating, said supervisory processor forward the error message to the second modem and said second modem forwards the error message over the communications line.

28. The method of monitoring the fullness of a waste container of claim 27, wherein:

the first modem and the second modem are connected to a common subscriber line;

the first modem is normally in an on state and the second modem is normally in an off state; and prior to said step of forwarding the error message to the second modem, said supervisory processor turns off the first modem and turns on the second modem.

* * * * *

UNITED STATES PATENT AND TRADEMARK OFFICE

CERTIFICATE OF CORRECTION

PATENT NO : 6 003 441
DATED : December 21, 1999
INVENTOR(S) : Jonathan A. Little

It is certified that error appears in the above-identified patent and that said Letters Patent is hereby corrected as shown below:

Column 13, line 19; change "link or said" to ---link or to---.

Column 15, line 26; change "compactor" to ---container---.
line 30; change "compactor" to ---container---.
line 31; change "compactor" to ---container---.
line 34; change "compactor" to ---container---.
line 36; change "compactor" to ---container---.
line 37; change "compactor" to ---container---.
line 40; change "compactor" to ---container---.
line 43; change "compactor" to ---container---.
line 45; change "compactor" to ---container---.
line 56; change "compactor state" to ---container state---.

Column 17, lines 7 & 8: change "communications line" to ---telephone network---.

Signed and Sealed this

Thirteenth Day of February, 2001

*Attest:*

Nicholas P. Godici

NICHOLAS P. GODICI

*Attesting Officer*

*Acting Director of the United States Patent and Trademark Office*